US005273865A

United States Patent [19]

Loiacono et al.

[11] Patent Number: 5,273,865

[45] Date of Patent: Dec. 28, 1993

[54] PHOTOGRAPHIC COLOR DEVELOPING COMPOSITION AND METHOD FOR PROCESSING A SILVER HALIDE COLOR PHOTOGRAPHIC ELEMENT

[75] Inventors: Marco Loiacono, Albissola Superiore; Carlo Marchesano, Savona, both of Italy

[73] Assignee: Minnesota Mining and Manufacturing Company, St. Paul, Minn.

[21] Appl. No.: 685,000

[22] Filed: Apr. 15, 1991

[30] Foreign Application Priority Data

Apr. 24, 1990 [IT] Italy ..... 20131 A/90

[51] Int. Cl.[5] ..... G03C 7/413

[52] U.S. Cl. ..... 430/490; 430/357; 430/467; 430/486

[58] Field of Search ..... 430/467, 485, 486, 490, 430/493, 357

[56] References Cited

U.S. PATENT DOCUMENTS

| | | | |
|---|---|---|---|
| 2,384,658 | 9/1945 | Vittum | 430/490 |
| 2,384,663 | 9/1945 | Weissberger et al. | 430/490 |
| 2,688,548 | 9/1954 | Reynolds | 430/490 |
| 2,691,589 | 10/1954 | Henn et al. | 430/490 |
| 3,839,045 | 10/1974 | Brown | 430/490 |
| 4,324,853 | 4/1982 | Berger | 430/491 |
| 4,543,322 | 9/1985 | Ishikawa et al. | 430/490 |
| 4,798,783 | 1/1983 | Ishikawa et al. | 430/490 |
| 4,920,041 | 4/1990 | Ohki et al. | 430/490 |
| 4,956,267 | 9/1990 | Ueda et al. | 430/490 |
| 5,002,862 | 3/1991 | Yagihara et al. | 430/490 |
| 5,071,734 | 12/1991 | Ueda et al. | 430/403 |

*Primary Examiner*—Hoa Van Le

*Attorney, Agent, or Firm*—Gary L. Griswold; Walter N. Kirn; Mark A. Litman

[57] ABSTRACT

A ready-to-use photographic color developing composition for the development of high bromide silver halide photographic element, said composition being substantially free of bromides, hydroxylamines and benzyl alcohol and comprising a color developing agent, a buffering agent, a complexing agent, an antifogging agent, a contrast promoting agent, an antioxidant agent and a polyol compound.

A rapid access processing method of a high bromide silver halide photographic color element, said method comprising the steps of:

developing said element for a period of about 75 to about 105 seconds in a ready-to-use color developing composition substantially free of bromides, hydroxylamines and benzylalcohol and comprising a color developing agent, a buffering agent, a complexing agent, an antifogging agent, a contrast promoting agent, an antioxidant agent and a compound of formula:

$$R—(OH)_n$$

wherein R is a straight or branched or alycyclic alkyle with 4 to 8 carbon atoms and n is an integer from 4 to 8, and containing said antioxidant agent in a quantity equal to or lower than 0.01 moles per liter with a developing agent to antioxidant agent molar ratio higher than or equal to 2:1, washing said element for a period of about 10 to about 20 seconds, bleach-fixing said element for a period of about 75 to about 105 seconds in a ready-to-use bleach and fix composition having a pH value in the range from 5 to 8 and having a bleaching agent to antioxidizing agent weight ratio equal to or lower than 20:1, and stabilizing said element, without washing between the bleach-fixing and stabilizing step, for a period of about 45 to about 75 seconds.

13 Claims, No Drawings

PHOTOGRAPHIC COLOR DEVELOPING COMPOSITION AND METHOD FOR PROCESSING A SILVER HALIDE COLOR PHOTOGRAPHIC ELEMENT

FIELD OF THE INVENTION

The present invention relates in general to photography and in particular to novel compositions and methods for processing a photographic color element. More specifically, the present invention relates to novel photographic color developing composition and to a novel method of rapid access processing of high bromide silver halide photographic elements utilizing such developing solutions.

In particular the photographic color developing composition of the invention has high sensitivity, a small load for prevention of environmental pollution, and enables rapid processing to be conducted without the need of plumbing and replenishement service.

BACKGROUND OF THE ART

Many kind of silver halide color photographic materials and methods of forming color images are commercially available at the present time. Various improvements and inventions thereon have been made depending on the end use.

The formation of color photographic images by the image-wise coupling of oxidized primary aromatic amino developing agents with color forming or coupling compounds to form indoaniline, indophenol, and azomethine dyes is well known. In these processes, the subtractive process of color formation is ordinarily used, and the image dyes customarily formed are cyan, magenta, and yellow, the colors that are complementary to the primary colors, red, green, and blue, respectively. Usually phenol or naphthol couplers are used to form the cyan dye image; pyrazolone or cyanoacetyl couplers are used to form the magenta dye image; and acylacetamide couplers are used to form the yellow dye image.

In these color photographic systems, the color-forming coupler may be either in the developer solution or incorporated in the light-sensitive photographic emulsion layer so that, during development, it is available in the emulsion layer to react with the color development agent that is oxidized by silver image development. Diffusible couplers are used in color developer solutions. Nondiffusible couplers are incorporated in photographic emulsion layers. When the dye image formed is to be used in situ, couplers are selected which form non-diffusing dyes. For image transfer color processes, couplers are used which will produce diffusible dyes capable of being mordanted or fixed in the receiving sheet.

It is generally desired that silver halide emulsion employed in these color photographic materials have high sensitivity. Therefore, silver iodobromide, silver chloroiodobromide or silver chlorobromide (each being mainly constituted of silver bromide) are generally used as the silver halide in the emulsions.

Silver halides mainly composed of silver bromide (i.e., at least 50% by molarity of anions) are theoretically disadvantageous for the purpose of rapid processing because the bromide ions which are released from the silver halides when they are developed have a development inhibiting function. From the standpoint of rapid processing, it is preferred to employ silver halides mainly composed of silver chloride. However, it is known that silver halide compositions mainly composed of silver chloride have some disadvantages in that they are apt to fog, particularly when they have a high development speed. They also tend to have poor preservation stability and have low sensitivity.

Because of the disadvantages described above, it is difficult for silver halides mainly composed of silver chloride to be exploited for their excellent developability in methods of forming image having relatively high sensitivity.

Various kinds of development accelerators have been investigated in order to increase the color forming property and to shorten the processing time in color development during processing of color photographic material. Particularly, benzyl alcohol is widely employed at present in this manner.

Increasingly, however, reduction of development processing time, simplification of the processing system and operation, and achievement of low environmental pollution are required of photographic products, in addition to high sensitivity.

These requirements are being made because reduction of the development period, simplification of laboratory work, improvement in miniaturization, and simple operation of the processing system for small scale laboratories are desired. With respect to said requirements, benzyl alcohol which is used in the color developing solution causes severe problems.

Since benzyl alcohol has a low water solubility, it is necessary to use solvents such as diethylene glycol in order to assist in dissolution of the benzyl alcohol. These compounds, including the benzyl alcohol, exhibit a large value of BOD (biological oxygen demand) and COD (chemical oxygen demand) which indicate a large load for prevention of environmental pollution. Therefore, it is desirable to eliminate these compounds to simplify protection of the environment. Also, it takes much time to dissolve benzyl alcohol in a developing solution even when a solvent is employed and, thus, it is desirable to eliminate benzyl alcohol to simplify work for the preparation of the developing solution. However, to simply eliminate benzyl alcohol results in a severe slowing of color development which is contrary to the needs of rapid processing in the market. Thus, it has been desired to develop a substitute for the use of benzyl alcohol.

Photographic color developing compositions used heretofore have typically been adapted for use with high bromide silver halide photographic elements. These conventional developing compositions tend to give less than satisfactory results.

For example, they typically contain restraining agents such as potassium bromide, which exert too great a retardation effect on development for obtaining a high value of D.max. Moreover, they typically contain hydroxylamine, or a water-soluble acid salt thereof, which functions as an antioxidant and thereby serves to protect the primary aromatic amino color developing agent against oxidation. Use of hydroxylamine, or a water-soluble acid salt thereof, is disadvantageous, however, since it tends to act as a scavenger which inactivates oxidized color developing agent before it can react with coupler to form dye. It can also act as a developing agent which competes with the color developing agent unless it is adequately restrained by bromide. In addition to hydroxylamine or a water-soluble acid salt thereof, developing solutions heretofore used with high bromide silver halide elements often contain substantial concentrations of sulfite to also provide protection against oxidation of the developing agent. The sulfite, which is typically utilized in the form of an alkali metal sulfite or bisulfite, functions to sulfonate oxidized color developing agent and, when used in sufficient concentration, its competition with coupler for oxidized color developing agent seriously affects dye formation.

In light of the above, it is clear that there is a need in the art to provide photographic color developing compositions useful to developing high bromide silver halide elements that reduce the problems heretofore mentioned.

SUMMARY OF THE INVENTION

The present invention relates to novel photographic color developing compositions and a novel method of rapid access processing, working with very small volumes of a ready-to-use chemical compositions to be totally replaced after each processing cycle.

The present invention also provides a novel photographic color developing composition and a novel method of rapid access processing, working with low concentrations of sulfite ions and with a very high developing agent to antioxidant agent molar ratio (that is, a molecular ratio between developing agent and sulfite ions equal to or higher than 2:1).

Another aspect of the present invention is to provide a novel photographic color developing composition and a novel method of rapid access processing, working in the substantial absence of benzyl alcohol, bromides, and hydroxylamine or water-soluble acid salts thereof.

Another aspect of the present invention is to provide a novel photographic color developing composition and a novel method of rapid access processing, to be used with high bromide content silver halide elements, giving high sensitivity, high color densities and controlled fog formation.

Other aspects of the present invention will become apparent from the following description and examples.

The present invention describes:

1) a ready-to-use photographic color developing composition for the development of high bromide silver halide photographic element, said composition being substantially free of bromides, hydroxylamines and benzyl alcohol and comprising: a color developing agent, a buffering agent, a complexing agent, an antifogging agent, a contrast promoting agent, an antioxidant agent and a polyol compound and, 2) a rapid access processing method of a high bromide silver halide photographic color element, said method comprising the steps of:

developing said element for a period of between about 75 to about 105 second in a color developing composition substantially free of bromides, hydroxylamines and benzylalcohol and comprising a color developing agent, a buffering agent, a complexing agent, an antifogging agent, a contrast promoting agent, an antioxidant agent and a polyol compound of formula:

$$R—(OH)_n$$

wherein R is a straight or branched or alycyclic alkyl group with 4 to 8 carbon atoms and n is an integer of from 4 to 8, and containing said antioxidant agent in a quantity equal to or lower than 0.01 moles per liter with a developing agent to antioxidant agent molar ratio higher than or equal to 2:1, washing said element for a period of about 10 to about 20 second, bleach-fixing said element for a period of about 75 to about 105 second in a ready-to-use bleach and fix composition having a pH value in the range from 5 to 8 and having a bleaching agent to antioxidizing agent weight ratio equal to or higher than 20:1, and stabilizing said element, without washing between the bleach-fixing and stabilizing step, for a period of about 45 to about 75 second.

DETAILED DESCRIPTION OF THE INVENTION

The aromatic primary amine color developing agent used in the photographic color developing composition of the present invention can be any of known compounds of the class of p-phenylendiamine derivatives, widely employed in various color photographic process. Particularly useful color developing agents are the p-phenylendiamine derivatives, especially the N,N-dialkyl-p-phenylene diamine derivatives wherein the alkyl groups or the aromatic nucleus can be substituted or not substituted.

Examples of p-phenilene diamine developers include the salts of: N,N-diethyl-p-phenylendiamine, 2-amino-5-diethylamino-toluene, 4-amino-N-ethyl-N(β-methanesulphonamidoethyl)-m-toluidine, 4-amino3-methyl-N-ethyl-N-(β-hydroxyethyl)-aniline, 4-amino-3-(β-methylsulfonamidoethyl)-N,N-diethylaniline, 4-amino-N,N-diethyl-3-(N'-methyl-β-methylsulfonamido)-aniline, N-ethyl-N-methoxy-ethyl-3methyl-p-phenylenediamine and the like, as described, for instance, in U.S. Pat. Nos. 2,552,241; 2,556,271; 3,656,950 and 3,658,525.

Examples of commonly used developing agents of the p-phenylene diamine salt type are: 2-amino-5diethylaminotoluene hydrochloride (generally known as CD2 and used in the developing solutions for color positive photographic material), 4-amino-Nethyl-N-(β-methanesulfonamidoethyl)-m-toluidine sesquisulfate monohydrate (generally known as CD3 and used in the developing solution for photographic papers and color reversal materials) and 4-amino-3methyl-N-ethyl-N-(β-hydroxy-ethyl)aniline sulfate (generally known as CD4 and used in the developing solutions for color negative photographic materials).

Said color developing agents are generally used in a quantity from about $1\times10^{-3}$ to about 0.1 moles per liter, preferably from about $4.5\times10^{-3}$ to about $4\times10^{-2}$ moles per liter of photographic color developing compositions.

The main problem of aqueous solutions of these color developing agents is the autooxidation process during storage condition. In fact, the more diluted the solution, the greater the rate of autooxidation.

It has been found that the presence of a high quantity of polyols reduces the autooxidation of the color developing agent in ready-to-use photographic color developing compositions.

By the term "ready-to-use photographic color developing composition" is meant a color developing composition able to process a photographic film without the need of diluition with water or other solvents before the use.

Polyol compounds useful in the color developing composition of the present invention are represented by the following formula:

$$R-(OH)_n$$

wherein R is a straight or branched or alycyclic alkyl group with 4 to 8 carbon atoms and n is an integer of from 4 to 8.

Examples of straight alkyl groups having 4 to 8 carbon atoms include n-butyl group, n-pentyl group, n-hexyl group, n-heptyl group; examples of branched alkyl groups having 4 to 8 carbon atoms include isobutyl group, t-butyl group, isopentyl group, neopentyl group, isohexyl group, 3-methylhexyl group; examples of alycyclic alkyl groups having 4 to 8 carbon atoms include cyclopentyl group, cyclohexyl group, and cycloheptyl group.

In a particular embodiment, polyol compounds useful in the color developing composition of the present invention are represented by the following formula:

$$\underset{OH}{CH_2}-\underset{OH}{(R)_m}-\underset{OH}{(CH)_n}-\underset{OH}{(R)_o}-\underset{OH}{CH_2}$$

wherein n is 1 or 2, m and o are independently 0 or 1, with the proviso that m+o is 1 or more, and R is $$-\underset{|}{CH}-CH_2- \text{ or } -CH_2-\underset{|}{CH}-.$$

In another particular embodiment, polyol compounds useful in the color developing composition of the present invention are represented by the following formula:

$$\underset{OH}{CH_2}-\underset{OH}{(CH)_n}-\underset{OH}{CH_2}$$

wherein n is an integer of from 2 to 6.

Polyols compounds useful in the color developing composition of the present invention are, for example, tetritols, such as erythritol, pentaerythritol and 1,2,4,5, tetrahydroxypentane, pentitols, such as ribitol, xylitol and 1,2,4,6,7-pentahydroxyheptane, hexitols, such as allitol, dulcitol, sorbitol, mannitol, inositol and 1,2,4,5,6,8-hexahydroxyoctane, heptitols, such as persitol and volemitol, octitols, such as D-erythro-D-galactooctitol.

In particular, polyol compounds have been found to give the best results when used in an amount providing a molecular ratio between developing agent and said polyol compounds in the range of from 1:5 to 1:30.

Additionally, the color developing agent must also be protected against aerial oxidation, which can easily occur during the working conditions.

For this reason it is common practice in the photographic art to include sulfite preservatives (i.e., any sulfur compounds capable of forming sulfite ions in aqueous solutions), hydroxylamine compounds, or ascorbic acid as an antioxidant agent in the photographic color developing compositions containing a primary aromatic amino color developing agent.

The color developing composition of the present invention is substantially free of hydroxylamine compounds. Sulfite preservatives and ascorbic acid are the preferred antioxidant agents. By the term "substantially free of hydroxylamine" it is meant that there is a concentration of hydroxylamine compounds of no more than (less than or equal to) about 0.5 g per liter of developing composition. It is preferred that there is less than 0.3 g of hydroxylamine per liter. In a more preferred embodiment the color developing composition of the present invention contains no hydroxylamine compounds at all.

The amount of sulfite preservative which can be tolerated in the color developing composition is limited by the fact that sulfite ions (or other organic antioxidant agents) compete with couplers for oxidized developing agent. This competition adversely affects dye formation and the final result is a lower D.Max in the dye image. Thus if the amount of sulfite is kept low enough so that the decrease in D.Max is slight, then the developing composition will not have adequate protection against aerial oxidation. If the amount of sulfite is increased to provide adequate protection against aerial oxidation, then the adverse effects on dye density will be severe and may reach unacceptable levels.

Typical examples of sulfite preservatives useful in the color developing composition of the present invention include sodium sulfite, potassium sulfite, lithium sulfite, ammonium sulfite, sodium bisulfite, potassium metabisulfite and bisulfite-formaldehide addition compound sodium salt.

The photographic color developing composition of the present invention is totally replaced after each processing cycle ("total loss developing composition"), i.e., said color developing composition is used to develop one roll of photographic film only. After development, the composition is completely exhausted. That means using an amount of the developer composition of not more than 200 ml, preferably not more than 100 ml, more preferably not more than 50 ml, for each processing cycle. For this reason the total quantity of sulfite ions can be strongly reduced since a shelf life of three days is more than enough to enable a processing time of from about 75 to about 105 seconds.

In a particular embodiment, the total amount of sulfite ions in the color developing composition of the present invention is equal to or lower than 0.01 moles per liter with a developing agent to antioxidant agent molar ratio equal to or higher than 2:1.

The total-loss developing composition of the present invention can be made substantially free of bromide, and as bromide is a very active development restrainer, its absence allows the attainment of more optical or image density (compensating the competing sulfite action) and enables a short development time. By the term "substantially free of bromide" is meant a concentration of bromide of not more than (less than or equal to) about 0.01 moles per mole of primary aromatic amino color developing agent.

For preventing subsequent losses in sulfite efficiency, by iron pollution for instance, an alkanolamine or a α-ketocarboxilic acid additive is useful.

Typical examples of α-ketocarboxylic acid compounds useful in the color developing composition of the present invention include glyoxylic acid, mesoxalic acid, pyruvic acid, oxalacetic acid, 2-ketoglutaric acid, 2-ketobutyric acid, phenylpyruvic acid and the like, as disclosed in EP Patent Application No. 254,195.

The color developing composition of the present invention is substantially free of benzyl alcohol. By the term "substantially free of benzyl alcohol" is meant a concentration of benzyl alcohol of not more than (less than or equal to) about 0.5 ml per liter of developing composition. In a preferred embodiment the color developing composition of the present invention contains no benzyl alcohol.

Instead of benzylalcohol, in order to increase the D.max value in the color formation, some compounds able to accelerate the coupling reaction and increase contrast can be added into the developer composition. Said compounds, containing a hydroxymethylidyne group, are represented by the following formula:

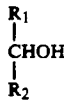

wherein R1 and R2 include a straight or branched chain alkyl group, a cycloalkyl group, an alkenyl group, an alkynyl group, an aromatic group. Examples of straight or branched chain alkyl groups are alkyl groups each having from 1 to 10, and preferably from 1 to 5 carbon atoms, such as a methyl group, an ethyl group, a propyl group, a butyl group. Examples of cycloalkyl groups are those including 3 to 10 carbon atoms. Specific examples therof are cyclopropyl group, cyclopentyl group, cyclohexyl group, adamantyl group. Examples of aromatic groups are phenyl group and naphthyl group.

Specific examples of said compounds are ethyl alcohol, β-phenylethyl alcohol, benzydrol, 1,3-butanediol, 1,4-butanediol, 1,5-pentanediol, 1,4-cyclo-hexanediol, phenylmethylcarbinol and mixtures thereof as disclosed in EP 182,293.

Other contrast promoting agents useful in the color developing composition of the present invention are the alkanolamine compounds which comprise amine compounds wherein the nitrogen atom is directly attached to a hydroxyl alkyl group. As stated above, a second useful characteristic of alkanolamine is an additional protection against oxidation.

Particularly preferred alkanolamine compounds, for use as contrast promoting agents, are the compounds of the following formula:

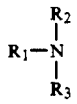

wherein $R_1$ represents a hydroxyalkyl group of 2 to 10 carbon atoms and $R_2$ and $R_3$ each represents a hydrogen atom, an alkyl group of 1 to 10 carbon atoms, a hydroxyalkyl group of 2 to 10 carbon atoms, a benzyl group, or a

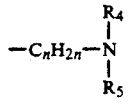

group wherein n is an integer from 1 to 10 and $R_4$ and $R_5$ each represents a hydrogen atom, an alkyl group from 1 to 10 carbon atoms, or a hydroxyalkyl group from 2 to 10 carbon atoms.

Typical examples of the numerous alkanolamine compounds that can be used in the color developing compositions of the present invention include: ethanolamine, diethanolamine, triethanolamine, di-isopropanolamine, 2-methylaminoethanol, 2-ethylaminoethanol, 2-dimethylaminoethanol, 2-diethylaminoethanol, 1-diethylamino-2-propanol, 3-diethylamino-1-propanol, 3-dimethylamino-1-propanol, isopropylaminoethanol, 3-amino-1-propanol, and the like, as disclosed in U.S. Pat. No. 4,269,929.

The absence or substantial absence of benzyl alcohol allows the bleach-fix to be utilized at a lower pH, limiting the risk of producing undesired leuco dye. At the same time low pH increases the rate of bleach-fix reaction, there by enabling the use of a short bleach-fix time, and, accordingly, facilitates accomplishment of the goal of a short total processing time. Moreover it allows the developing composition components to be more easily mixed.

At least an inorganic alkali agent is used in the color developing compositions of this invention to achieve the preferred pH range which normally is above 10. The inorganic alkali agent group includes KOH, NaOH, $K_2CO_3$ and $Na_2CO_3$, etc.

Other adjuvants well known in the art are comprised in the developer compositions of this invention; these include inorganic antifogging agents known in the art to eliminate fog on the developed photographic silver halide films. In the ready-to-use color developing composition of this invention, said compounds include derivatives of benzimidazole, benzotriazole, tetrazole, indazole, thiazole, etc. Preferably, particular mixtures of these antifogging agents are useful to assure low fog levels; such preferred mixtures include mixtures of 5-nitroindazole and benzimidazole nitrate, 5-nitrobenzotriazole and 1-phenyl-1-H-tetrazole-5thiol and benzotriazole and/or derivatives and 1-phenyl-1-H-tetrazole-5-thiol.

In particular 5-methyl-benzotriazole has been found to give the best results when used in an amount needed to have a molecular ratio between developing agent and said antifogging agent in the range from 1:0.001 to 1:025.

Other adjuvants are buffering agents (e.g. borates, carbonates and phosphates) and sequestering agents such as aminopolycarboxylic acid compounds (e.g. nitrilotriacetic acid or NTA, ethylenediaminotetracetic acid or EDTA, diethylenetriaminopentacetic acid or DTPA, diaminopropanoltetracetic acid or DPTA and ethylenediamino-N,N,N',N'-tetrapropionic acid or EDTP), cyclicaminomethane diphosphonic acid as disclosed in EP Patent Application No. 286,874, α-hydroxycarboxylic acid compounds (e.g. lactic acid), dicarboxylic acid compounds (e.g. oxalic acid compounds (oxalic acid and malonic acid) or polyphosphate compounds (e.g. sodium hexamataphosphate).

In the total processing of a image-wise photographic element, it is necessary, after development, to remove the silver image which is formed coincident with the dye image. This can be done by oxidizing the silver by means of a suitable oxidizing agent, commonly referred to as a bleaching agent, in the presence of halide ions following by dissolving the silver halide so formed in a silver halide solvent, commonly referred to as a fixing agent. Alternatively, the bleaching agent and fixing agent can be combined in a bleach-fixing composition and the silver removed in one step by use of such composition. The bleaching agent is typically a ferric complex of an aminopolycarboxylic acid, most usually the ferric complex of ethylenediaminotetracetic acid (EDTA). The fixing agent is typically a thiosulfate such as sodium thiosulfate or ammonium thiosulfate.

Since the bleaching agent is an oxidizing agent whilst the fixing agent is a reducing agent, these two antagonistic actions would appear to preclude the coexistence of the bleaching and fixing actions in the same composition for the processing time. Of course the decomposition of the fixing agent can be easily slowed down by adding into a bleach-fix ready-to-use composition an antioxidant agent (as, for example, an alkali metal sulfite) in a quantity directly proportional to the total quantity of the bleaching agent present in the bleach-fix ready-to-use composition.

The photographic bleach-fix composition of the present invention is totally replaced after each processing cycle ("total loss bleach-fix composition"), i.e., said bleach-fix composition is used in an amount able to bleach-fix one roll of photographic film only. After that, the bleach-fix composition is completely exhausted. That allows the use of an amount of less than or equal to 200 ml, preferably not more than 100 ml, more preferably not more than 50 ml, for each processing cycle. At least 5 ml and usually at least 10 ml will be used, allowing ranges of volume of 5–200, 5–100, 10–100, 5–50, or 10–50 ml of composition. For this reason the bleaching agent to antioxidizing agent weight ratio can be strongly reduced, because a shelf-life of three days is more than enough to allow for a processing time from about 75 to about 105 seconds.

In particular, in the bleach-fixing composition of the present invention the bleaching agent to antioxidizing agent weight ratio is equal to or higher than 20:1.

On the other hand, this very high bleaching agent to antioxidizing agent ratio gives a remarkable improvement to complete the cyan dye development (avoiding in this way the formation of red shadow in D.max) because the oxidizing capacity of the bleaching agent is strongly improved.

The color developing and bleach-fix compositions of the present invention can be applied to the processing of incorporated coupler silver halide photographic materials, for example, multilayer color material containing a support base having superimposed at least one red sensitive silver halide emulsion layer containing cyan-forming couplers (e.g., phenolic and naphtholic compounds), at least one green sensitive silver halide emulsion layer containing magenta forming couplers (e.g., 5-pyrazolone, cyanoacetilic and pyrazolo-triazole compounds), and at least one blue sensitive silver halide emulsion layer containing yellow forming couplers (e.g., open chain ketomethylene compounds).

The order of the disposition of these emulsion layers can be suitably selected depending on demands. Further, each of the above described emulsion layers may be composed of two or more emulsion layers having different sensitivities. Moreover, between two or more emulsion layers sensitive to the same spectral wavelenght range, a light insensitive layer may be present.

In particular, the light sensitive silver halide emulsion layers above described contain high bromide silver halide grains. By the term "high bromide" is meant a content of bromide in the total silver halide grains of at least 50% mol, preferably higher than 70% and more preferably higher than 80%, In the color photographic light sensitive material may be present a subsidiary layer such as a protective layer, an interlayer, a filter layer, an antihalation layer and a back layer in addition to the silver halide emulsion layers.

Moreover, into said color photographic light sensitive material can be incorporated various kind of stabilizers, contamination preventing agents, developing agents or precursors thereof, development accelerating agents or precursors thereof, lubricants, mordants, matting agents, antistatic agents, plasticizers, or other additives useful for photographic light sensitive materials in addition of the above described additives. Typical examples of these additives are described in Research Disclosure, No. 17643 (December, 1978) and Research Disclosure No. 18716 (November, 1979).

The invention is further illustrated by the following example of its practice.

EXAMPLE

On cellulose triacetate support, having a subbing layer and provided with an antihalo layer of colloidal silver, emulsion layers and assistant layers were coated in a conventional disposition, to prepare samples of photographic films.

The color graphic film has the following composition:

| | |
|---|---|
| 1st layer (Red sensitive) | |
| Silver chloro bromide emulsion with 88% mol of Br | |
| Gelatin | 1.54 g/sqm |
| Silver | 0.50 g/sqm |
| Cyan coupler | 0.83 g/sqm |
| 2nd layer (Interlayer) | |
| Gelatin | 0.94 g/sqm |
| Color mixing inhibitor | 0.088 g/sqm |
| Ultraviolet absorber | 0.17 g/sqm |
| 3rd layer (Green sensitive) | |
| Silver chlorobromide emulsion with 88% mol of Br | |
| Gelatin | 1.58 g/sqm |
| Silver | 0.60 g/sqm |
| Magenta coupler | 1.08 g/sqm |
| 4th layer (Interlayer) | |
| Gelatin | 0.94 g/sqm |
| Color mixing inhibitor | 0.088 g/sqm |
| Ultraviolet absorber | 0.17 g/sqm |
| 5th layer (Yellow filter) | |
| Gelatin | 1.55 g/sqm |
| Silver | 0.10 g/sqm |
| 6th layer (Blue sensitive) | |
| Silver chlorobromide emulsion with 88% mol of Br | |
| Gelatin | 2.32 g/sqm |
| Silver | 0.93 g/sqm |
| Yellow coupler | 1.55 g/sqm |
| 7th layer (Top coat) | |
| Gelatin | 1.01 g/sqm |
| Polymethylmetacrylate | 0.157 g/sqm |

Each of the red, green and blue sensitive emulsions is spectrally sensitized.

Strips of the color photographic film were exposed to an intensity light of 17,000 Lux for 1/20 sec using a continuous optical wedge with a color temperature of 5500° K. and were processed in a four-step process consisting of a 90 second development step, a 15 second washing step, a 90 second bleach-fix step and a 60 second stabilizing step for a total process time of 4 minutes and 45 second.

A lot of six color developing compositions were prepared according the following table 1.

TABLE 1

| Compounds | A | B | C | D | E | F |
|---|---|---|---|---|---|---|
| Deionized water | 750 | 750 | 750 | 750 | 750 | 750 |
| Ethylene glycol | 85 | 85 | 85 | 85 | 85 | 85 |
| Sorbitol | — | 100 | 100 | 100 | 100 | 100 |
| Ascorbic acid | 0.70 | 0.70 | 0.70 | 0.70 | 0.70 | 0.70 |
| 5-methyl-benzo-triazole | 0.035 | 0.035 | 0.035 | 0.035 | 0.035 | 0.035 |
| Sodium methabi-sulfide | 0.80 | 0.80 | 0.80 | 0.80 | 4 | 0.80 |
| $CD_3$-[3/2$H_2SO_4$]—$H_2O$ | — | — | — | — | — | 11 |
| $CD_4$—$H_2SO_4$—$H_2O$ | 11 | 11 | 11 | 11 | 11 | — |
| Diethanolamine | 40 | — | 40 | 40 | 40 | 40 |
| Potassium carbonate | 35 | 35 | 35 | 35 | 35 | 35 |
| KOH 35% sol. | 9.5 | 12 | 9.5 | 9.5 | 13.5 | 8.5 |
| Benzhydrol | — | — | — | 0.5 | — | — |
| pH a 20° C. | 11 | 11 | 11 | 11 | 11 | 11 |
| Specific gravity a 20° C. g/l | 1.05 | 1.08 | 1.08 | 1.08 | 1.08 | 1.08 |
| Molecular ratios | | | | | | |
| dev. agent-sulfite | 1:0.24 | 1:0.24 | 1:0.24 | 1:0.24 | 1:1.19 | 1:0.24 |
| dev. agent-sorbitol | 1:15.5 | 1:15.5 | 1:15.5 | 1:15.5 | 1:15.5 | 1:21.8 |
| dev. agent-5-methyl-benzotriazole | 1:0.007 | 1:0.007 | 1:0.007 | 1:0.007 | 1:0.007 | 1:0.010 |
| Shelf life (days) | 1 | 3 | 5 | 5 | 5 | 5 |

The pH must be checked after 24 hours from the preparation to ensure a constant value.

The shelf life test of the above color developing compositions shows that sorbitol confers a remarkable protection against the autoxidation process (see compositions C and A). Composition C versus B shows the additional protection of alkanolamine compounds.

A lot of three color bleach-fix compositions were prepared according the following table 2.

TABLE 2

| Compounds | | A | B | C |
|---|---|---|---|---|
| Deionized water | ml | 400 | 400 | 400 |
| Diethanolamine | g | 5 | 5 | 5 |
| Sodium sulfite | g | 1 | 1 | 10 |
| Sodium methabisulfite | g | 0.75 | 0.75 | 7.5 |
| Acetic acid | g | 8.5 | 8.5 | 8.5 |
| KOH sol. 35% | ml | 8 | 8 | 8 |
| Ammonium thiosulfate solution 60% | ml | 70 | 70 | 70 |
| EDTA $NH_4$ Fe | g | 110 | 51 | 110 |
| EDTA $(NH_4)_2$ $H_2$ | g | 22 | 10 | 22 |
| Acetic acid to make pH at 20° C. | | 6.52 | 6.5 | 6.5 |
| Specific gravity | g/l | 1.09 | 1.053 | 1.102 |
| Weight ratio EDTA $NH_4$Fe-sulfite | | 1:0.015 | 1:0.025 | 1:0.115 |
| Shelf life (days) | | 5 | 14 | 30 |

The coexistence of bleaching and fixing agent in a single composition, for selling without any problem of stability needs a shelf life of as much as two years. This is not the requirement of the proposed formulas and therefore the bleach-fix composition of the present invention must be manufactured in two concentrated parts, to be mixed immediately before use, as shown in the following table 3.

TABLE 3

| CONCENTRATE SOLUTIONS (from formula A of previous Table 2) | | | |
|---|---|---|---|
| Compounds | Part A | | Part B |
| Deionized water | g | 900 | — |
| Diethanolamine | g | 10 | — |
| Sodium sulfite | g | 2 | — |
| Sodium methabisulfite | g | 1.5 | — |
| Acetic acid | g | 16.5 | — |
| KOH sol. 35% | g | 16 | — |
| Ammonium thiosulfate sol. 60% | g | 140 | — |
| EDTA $NH_4$ Fe | g | — | 500 |
| EDTA $(NH_4)_2$ $H_2$ | g | — | 220 |
| Acetic acid | | | for final pH |
| Deionized water to make | ml | 1000 | 1000 |
| pH at 20° C. | | 5.0 | 6.5 |
| Specific gravity at 20° C. | g/l | 1.051 | 1.125 |
| To prepare 1 liter of ready-to-use composition A of Table 2 | ml | 500 | 500 |

Photographic properties of the processed color photographic film are evaluated in terms of minimum and maximum densities and relative sensitivity of each color layer. The sensitivity is a relative value of a reciprocal of an exposure required for providing a density of 1.0 plus fog. The gradient is expressed in terms of a density difference between a density of 0.4 plus fog to density point at 0.30 lgE greater exposure.

Sensitometric results of the photographic color film processed according to the above processing method, using the color developing compositions of the table 1 plus reference 3M CPP 2 color developing solution and Kodak C41 color developing solution and the bleach-fix compositions of table 2 plus reference 3M CPP 2 NR bleach-fix solution, are shown in the following table 4.

TABLE 4

| Color developing solutions | Blix solutions | D min | | | D max | | |
|---|---|---|---|---|---|---|---|
| | | blue | green | red | blue | green | red |
| A | A | 0.08 | 0.09 | 0.07 | 2.98 | 3.07 | 2.99 |
| B | A | 0.07 | 0.08 | 0.07 | 2.33 | 2.36 | 1.21 |
| C | A | 0.08 | 0.10 | 0.10 | 3.45 | 3.12 | 3.13 |
| C | C | 0.09 | 0.11 | 0.10 | 3.54 | 3.07 | 2.88 |
| E | A | 0.08 | 0.10 | 0.10 | 3.03 | 2.85 | 2.88 |

TABLE 4-continued

| Color developing solutions | Blix solutions | D min | | | D max | | |
|---|---|---|---|---|---|---|---|
| | | blue | green | red | blue | green | red |
| F | C | 0.08 | 0.09 | 0.10 | 2.82 | 2.74 | 2.71 |
| C | B | 0.11 | 0.12 | 0.11 | 3.30 | 3.00 | 2.70 |
| D | A | 0.10 | 0.12 | 0.14 | 3.84 | 3.09 | 3.11 |
| F | A | 0.07 | 0.08 | 0.07 | 2.19 | 2.62 | 2.23 |
| C | 3M CPP2 NR | 0.08 | 0.08 | 0.09 | 3.47 | 2.98 | 2.57 |
| E | 3M CPP2 NR | 0.08 | 0.08 | 0.09 | 2.95 | 2.68 | 2.43 |
| 3M CPP2 | 3M CPP2 NR | 0.23 | 0.09 | 0.10 | 3.45 | 1.32 | 0.89 |
| Kodak C41 | 3M CPP2 NR | 0.10 | 0.10 | 0.10 | 2.40 | 1.23 | 2.00 |

The color developing and bleach-fix compositions of specific formulation indicate that color developing agent CD4 gives better densities than CD3 (example F+C) and when the quantity of sulfite is very low (example C+A and D+A) the color densities are at the higher values, with a further increase on yellow density in presence of benzydrol (example D+A). Alkanolamine works as color density promoting agent, as shown in the example B+A, where in the absence of diethanolamine, the color densities are at the lowest value. In conclusion, the best color developing composition, according the present invention, is that of the example D and the best bleach-fix composition, according the present invention, is that of the example A.

We claim:

1. A ready-to-use photographic color developing composition for the development of silver halide photographic element having at least one silver halide emulsion layer in which the silver halide comprises at least 50 mol percent silver bromide, said composition being substantially free of bromides, hydroxylamines and benzyl alcohol and comprising a color developing agent, a buffering agent, a complexing agent, an antifogging agent, a contrast promoting agent and an antioxidant agent characterized in that said composition contains a polyol compound having four to eight hydroxyl groups.

2. The photographic color developing composition according to claim 1 characterized in that said polyol compound is represented by the following formula:

$$R-(OH)_n$$

wherein R is a straight or branched or alycyclic alkyl with 4 to 8 carbon atoms and n is an integer of from 4 to 8.

3. The photographic color developing composition according to claim 1 characterized in that said polyol compound is represented by the following formula:

$$\underset{OH}{CH_2}-\underset{OH}{(R)_m}-\underset{OH}{(CH)_n}-\underset{OH}{(R)_o}-\underset{OH}{CH_2}$$

wherein n is 1 or 2, m and o are independently 0 or 1, with the proviso that m+o is 1 or more, and R is $$-\underset{|}{CH}-CH_2- \text{ or } -CH_2-\underset{|}{CH}-.$$

4. The photographic color developing composition according to claim 1 characterized in that said polyol compound is represented by the following formula:

$$\underset{OH}{CH_2}-\underset{OH}{(CH)_n}-\underset{OH}{CH_2}$$

wherein n is an integer of from 2 to 6.

5. The photographic color developing composition according to claim 1 characterized in that said polyol compound is selected from one or more of erythritol, pentaerythritol, ribitol, xylitol, allitol, dulcitol, sorbitol, mannitol, inositol, persitol, volemitol, D-erythro-D-galacto-octitol.

6. The photographic color developing composition according to claim 2 characterized in that the molecular ratio between said developing agent and said polyol compound is in the range from 1:5 to 1:30.

7. The photographic color developing composition according to claim 2 characterized in that said antioxidant agent is a compound forming sulfite ions in a quantity equal to or lower than 0.01 moles per liter with a developing agent to antioxidant agent molar ratio higher than or equal to 2:1.

8. The photographic color developing composition according to claim 2 characterized in that said antifogging agent is 5-methylbenzotriazole and said antifogging agent is present in an amount needed to have a molecular ratio between said developing agent and said antifogging agent in the range from 1000:1 to 4:1.

9. The photographic color developing composition according to claim 2 characterized in that said composition further comprises a compound having a hydroxymethylidyne group represented from the following formula:

$$\begin{array}{c} R_1 \\ | \\ CHOH \\ | \\ R_2 \end{array}$$

wherein $R_1$ and $R_2$ each represent a hydrogen atom, an aliphatic group, an aromatic group, a heterocyclic group, or $R_1$ and $R_2$ together complete a non aromatic cyclic group, $R_1$ and $R_2$ having together a total of at least three carbon atoms.

10. The color photographic developing composition of claim 1 wherein said polyol compound comprises erythritol.

11. A rapid access processing method of a high bromide silver halide photographic color element, said method comprising the steps of:

developing said element for a period of about 75 to about 105 second in a ready-to-use color developing composition substantially free of bromides, hydroxylamines and benzylalcohol and comprising a color developing agent, a buffering agent, a complexing agent, an antifogging agent, a contrast promoting agent, an antioxidant agent and a compound of formula:

$$R-(OH)_n$$

wherein R is a straight or branched or alycyclic alkyle with 4 to 8 carbon atoms and n is an integer from 4 to 8, and containing said antioxidant agent in a quantity equal to or lower than 0.01 moles per liter with a developing agent to antioxidant agent molar ratio higher than or equal to 2:1, washing said element for a period of about 10 to about 20 second, bleach-fixing said element for a period of about 75 to about 105 second in a ready-to-use bleach and fix composition having a pH value in the range from 5 to 8 and having a bleaching agent to antioxidizing agent weight ratio equal to or higher than 20:1, and stabilizing said element, without washing between the bleach-fixing and stabilizing step, for a period of about 45 to about 75 second.

12. A single usage ready-to-use color developing composition for the development of a silver halide photographic element having at least one silver halide emulsion layer in which said silver halide comprises at least 50 mol percent of silver bromide, said composition being substantially free of bromides, hydroxylamines and benzyl alcohol and comprising a color developing agent, a buffering agent, a complexing agent, an antifogging agent, a contrast promoting agent and an antioxidant agent characterized in that said composition comprises an aliphatic or alicyclic polyol compound having at least four hydroxy group in an amount of from 10 to 200 grams per liter of developing composition and in that the molecular ratio between said developing agent and said polyol is in the range of from 1:5 and 1:30.

13. A single usage ready-to-use color developing composition for the development of a silver halide photographic element having at least one silver halide emulsion layer in which said silver halide comprises at least 50 mol percent of silver bromide, said composition being substantially free of bromides, hydroxylamines and benzyl alcohol and comprising a color developing agent, a buffering agent, a complexing agent, an antifogging agent, a contrast promoting agent and an antioxidant agent characterized in that said composition further comprises sorbitol.

* * * * *